US007490554B2

(12) United States Patent
Lynch et al.

(10) Patent No.: US 7,490,554 B2
(45) Date of Patent: Feb. 17, 2009

(54) INITIATION FIXTURE AND AN INITIATOR ASSEMBLY INCLUDING THE SAME

(75) Inventors: David C. Lynch, Burlington, CT (US); Ronald M. Dufrane, North Granby, CT (US); Jeffrey M. Kezerian, Simsbury, CT (US); Jack C. Cotner, Madisonville, KY (US)

(73) Assignee: Ensign-Bickford Aerospace & Defence Company, Simsbury, CT (US)

( * ) Notice: Subject to any disclaimer, the term of this patent is extended or adjusted under 35 U.S.C. 154(b) by 0 days.

(21) Appl. No.: 11/925,220

(22) Filed: Oct. 26, 2007

(65) Prior Publication Data

US 2008/0047452 A1 Feb. 28, 2008

Related U.S. Application Data

(63) Continuation of application No. 10/504,612, filed as application No. PCT/US03/04593 on Feb. 14, 2003, now abandoned.

(60) Provisional application No. 60/357,464, filed on Feb. 15, 2002.

(51) Int. Cl.
*C06C 5/06* (2006.01)

(52) U.S. Cl. ..... 102/275.11; 102/275.2; 102/275.6; 102/275.12

(58) Field of Classification Search ..... 102/275.11, 102/275.1, 275.2, 275.6, 275.12
See application file for complete search history.

(56) References Cited

U.S. PATENT DOCUMENTS 953,588 A 3/1910 Bramwell-Smith
954,595 A 4/1910 Spery
968,185 A 8/1910 Myrick
3,241,489 A 3/1966 Andrew et al.
3,296,968 A 1/1967 Shulman et al.
3,661,087 A 5/1972 Willard et al.
3,987,732 A 10/1976 Spraggs et al.
4,265,177 A 5/1981 Lundborg et al.
4,424,747 A 1/1984 Yunan
4,759,291 A 7/1988 Barker et al.

(Continued)

OTHER PUBLICATIONS

PCT International Search Report for PCT/US03/04593, mailed Aug. 14, 2003, 4 pages.

(Continued)

*Primary Examiner*—Stephen M Johnson
(74) *Attorney, Agent, or Firm*—Cantor Colburn LLP

(57) ABSTRACT

An initiator assembly (38) is factory-pre-assembled and comprises an initiation fixture (10) secured to a triggering device (40). The initiation fixture (10) comprises a unitary body, i.e., one without moving parts, and includes a bushing groove (18) to receive as an accessory an O-ring (64) to seal the device within the barrel (42) of the triggering device (40). A fuse/fixture sub-assembly (34) includes an initiation charge (30) disposed at the firing face (13*a*) and a signal-transmission fuse (22). The initiation fixture (110) may be a "universal" fixture having thereon optional external threads (36) and being otherwise dimensioned and configured to be received within either an internally threaded barrel (42) of a triggering device (40) or the barrel (42) of a triggering device which utilizes a fuse-holder cap (56). The initiator assembly (38) may include a spool (66) on which the signal-transmission tube (22) is wound.

9 Claims, 7 Drawing Sheets

U.S. PATENT DOCUMENTS

| | | | | |
|---|---|---|---|---|
| 4,846,067 | A | 7/1989 | Martin | |
| 4,998,477 | A | 3/1991 | Barker | |
| 5,327,835 | A | 7/1994 | Adams et al. | |
| 5,365,851 | A * | 11/1994 | Shaw | 102/275.6 |
| 5,413,046 | A | 5/1995 | Sobczak et al. | |
| 5,417,162 | A | 5/1995 | Adams et al. | |
| 6,272,996 | B1 * | 8/2001 | O'Brien et al. | 102/275.11 |
| 6,305,287 | B1 * | 10/2001 | Capers et al. | 102/275.7 |

OTHER PUBLICATIONS

PCT Written Opinion for PCT/US03/04593, mailed Sep. 2, 2004, 5 pages.

http://www.norabel.com/3.htm, print-out dated Feb. 12, 2002, Norabel Ignition Systems, User Manual Shock Tube System, 6 pages.

Shock Tube Systems, Inc. Technical Bulletin, "Military Demolition Dual Minitube Non-Electric Detonator M-19", 2 pages. No date is listed on the Bulletin.

* cited by examiner

INITIATION FIXTURE AND AN INITIATOR ASSEMBLY INCLUDING THE SAME

CROSS-REFERENCE TO RELATED APPLICATIONS

This application is a continuation of patent application Ser. No. 10/504,612 now abandoned, which is a national stage filing of PCT/US03/04593, with an effective Section 371 filing date of Feb. 17, 2005, which international application PCT/US03/04593 was filed on Feb. 14, 2003, and claims the benefit of U.S. provisional application Ser. No. 60/357,464 filed Feb. 15, 2002, all entitled "Initiation Fixture and an Initiator Assembly Including the Same".

BACKGROUND OF THE INVENTION

1. Field of the Invention

The present invention concerns an initiation fixture and initiator assembly including the fixture. The initiator assembly facilitates the initiation of a signal in a non-electric fuse such as a signal-transmission tube, e.g., shock tube. The initiator assembly comprises a triggering device within which the initiation fixture is received. The triggering device initiates a signal within the fuse which signal serves to initiate a detonator or other signal-transmitting or explosive device connected to the remote end of the fuse.

2. Related Art

U.S. Pat. No. 5,365,851 to Shaw, issued Nov. 22, 1994 and entitled "Initiator Device", discloses (see FIGS. 1 and 2) an initiation fixture (16) for an impulse transmission tube comprising a sleeve (30) in which a shock tube fuse (10) is received. A primer (percussion) cap (28) is contained at one end of sleeve (30) in signal-transfer proximity to the input end of the shock tube (10); the opposite (output) end of shock tube (10) has a detonator (14) secured thereto. An internal fence (32) establishes a touch hole (33) between the primer cap (28) and the input end of the shock tube (10). A threaded retainer means (40) is movably and rotatably disposed on the exterior surface of sleeve (30) to engage internal threads formed in the end of barrel (22) of a triggering device (18). A first stop means (42) positions retainer (40) to properly locate primer cap (28) for detonation by operation of a striking firing pin (20) of triggering device (18). An initiation fixture such as fixture (16) of Shaw U.S. Pat. No. 5,365,851 is usable only with a triggering device having the interior threads needed to accommodate the exterior threads on the body of the device.

Triggering devices for use in firing initiation fixtures such as those disclosed by the above-described Shaw U.S. Pat. No. 5,365,851 ("the Shaw patent"), are usually comprised of a barrel containing at one end a trigger-operated, spring-loaded firing pin and having, at the other (output) end of the barrel, means for connecting the initiation fixture to the barrel. Alternatively, the triggering device may contain a percussion cap and a structure for receiving and retaining the input end of a fuse in signal-transfer proximity to the percussion cap. In such case, the output end of the barrel of the triggering device usually contains a grommet or other tube-retaining structure within or aligned with an aperture formed in a fuse-holder cap fitted over the output end of the barrel. The input end of the fuse is simply inserted into the aperture and advanced until it encounters a stop member, at which point the fuse is positioned within the barrel in signal-transfer proximity to the initiation charge of the triggering device, provided only that the user has taken care to fully insert the fuse. Such triggering devices usually employ a safety mechanism and, once the safety mechanism is placed in the armed position, the trigger of the device is operated so that the firing pin strikes and initiates the initiation charge, thereby initiating a signal in the fuse. As illustrated in the Shaw patent, the other (output) end of the fuse may be connected to a detonator; obviously, it may be connected to any other device which is operated by the signal engendered in the fuse.

Whether an initiation fixture such as that of the Shaw patent is utilized, or whether the input end of the fuse is simply inserted into a triggering device containing its own initiation charge, assembly of the initiator to the triggering device or insertion of the exposed end of the fuse is required in the field at the point of use. Such field assembly or insertion may be difficult because of weather conditions or darkness, and exposes the necessarily open input end of the fuse and the interior of the triggering device to the elements, with potential adverse consequences on reliability of initiation.

SUMMARY OF THE INVENTION

Generally, in accordance with the present invention, there is provided an initiation fixture which is so dimensioned and configured that it may be utilized in a factory-assembled or pre-assembled initiator assembly of the invention. Such initiator assembly serves to initiate a signal in a fuse in order to detonate explosives and the like. The pre-assembled initiator assembly avoids the necessity for field assembling an initiation fixture or an exposed end of the fuse to a triggering device, as is required with the known prior art devices. Such field assembly is particularly problematic in adverse weather conditions, at night, and most particularly, in combat or clandestine use situations. Factory- or other pre-assembly of the initiator assembly facilitates a secure and weatherproof installation, and enables field use simply by operating the triggering device.

The present invention also provides a "universal" initiation fixture which may be assembled either to a triggering device having an interior thread to secure the fixture, to a triggering device using a fuse-holder cap.

Specifically, in accordance with the present invention, there is provided an initiator assembly comprising a triggering device having a barrel comprising an output end and an interior surface, the barrel having disposed therein an internal positioning member and a firing mechanism comprising a firing pin. An initiation fixture is of unitary construction so that no part thereof is movable relative to any other part thereof. The initiation fixture is secured to the triggering device and comprises: (i) a cylindrical body member having an external surface, an end face and a firing face, the body member being received within the barrel of the triggering device at the output end thereof, (ii) a longitudinal internal passage extending through the body member, (iii) an external positioning member disposed on the external surface of the body member and engaging the internal positioning member, thereby positioning the body member at a predetermined position within the barrel, and (iv) an initiation charge disposed within the longitudinal internal passage at the firing face of the body member and exposed to the firing pin of the firing mechanism; and a signal-transmission fuse secured to and extending from the body member and having an input end disposed in signal-transfer relation to the initiation charge, and an opposite output end.

In accordance with one aspect of the present invention, the internal positioning member comprises an internal stop and the external positioning member comprises a shoulder, wherein the shoulder abuts the internal stop thereby properly positioning the body member within the barrel of the triggering device.

In accordance with another aspect of the present invention, the internal positioning member comprises internal threads in the barrel and the external positioning member comprises external threads on the firing face of the body member, wherein the external threads of the body member engage the internal threads of the triggering device to properly position the body member within the barrel of the triggering device.

In accordance with another aspect of the present invention, the triggering device is mounted on a spool on which the signal-transmission fuse is wound.

In accordance with another embodiment of the present invention, there is provided an initiation fixture dimensioned and configured to be received within a barrel of a triggering device. The initiation fixture comprises a cylindrical body member having an external surface, an end face and a firing face. The body member is dimensioned and configured to be received within a barrel of a triggering device. There is a longitudinal internal passage which extends through the body member and a positioning member disposed on the external surface of the body member dimensioned and configured to position the body member within the barrel. A well is formed in the body member at the firing face thereof and is dimensioned and configured to receive an initiation charge, the well being in signal-transfer communication with the longitudinal internal passage. The initiation fixture is of unitary construction, by which it is meant that no part thereof is movable relative to any other part thereof.

In accordance with yet another embodiment of the present invention, there is provided an initiator assembly comprising a spool having a signal-transmission fuse wound thereon, the signal-transmission fuse having an input end and an opposite, output end. A triggering device is mounted upon the spool, and has a barrel comprising an output end, the barrel having a firing mechanism disposed therein. An initiation fixture comprises a cylindrical body member received within the barrel of the triggering device at the output end thereof, a longitudinal internal passage which extends through the body member, and an initiation charge disposed within the longitudinal internal passage of the body member and exposed to the firing mechanism. The input end of the signal-transmission fuse is disposed within and secured to the initiation fixture in signal-transfer relation to the initiation charge.

Other aspects of the present invention are revealed in the following description and the appended drawings.

The term "signal" used in connection with a signal-transmission tube fuse means the detonating shock wave or deflagrating flame front transmitted along the tube interior and utilized to obtain a desired effect, such as to initiate a detonator, which may in turn initiate an explosive charge.

DETAILED DESCRIPTION OF THE INVENTION AND PREFERRED EMBODIMENTS THEREOF

Figure 1:
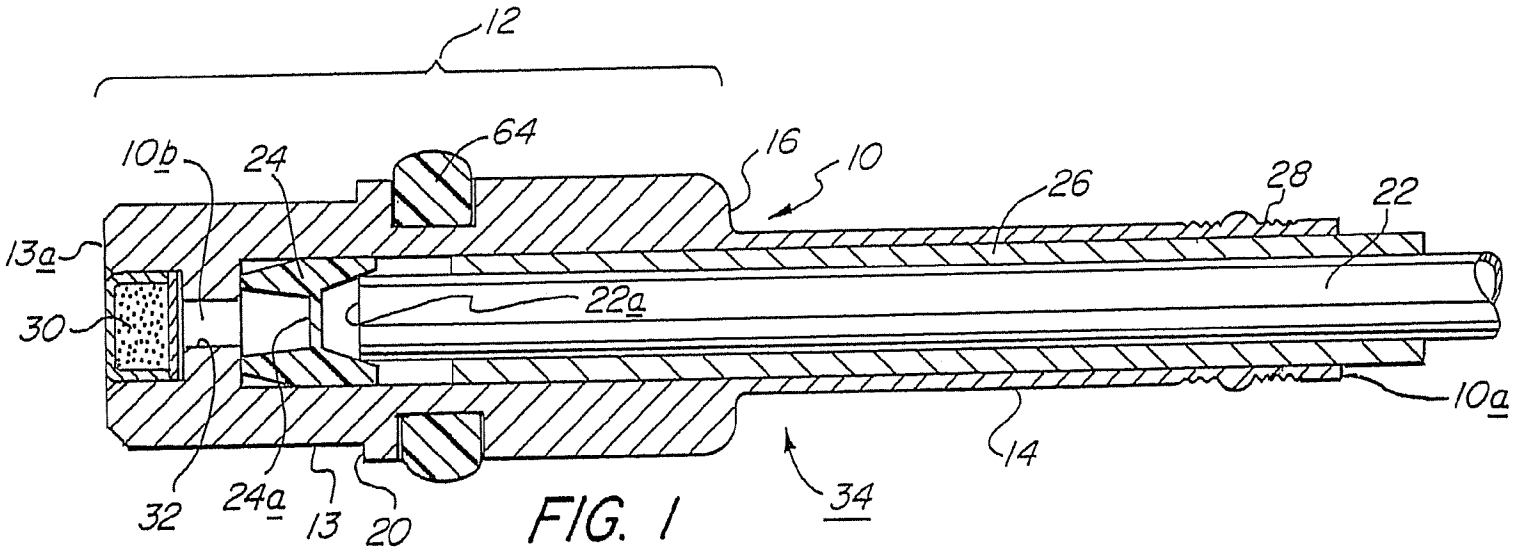
FIG. 1 is a cross-sectional view of an initiation fixture in accordance with one embodiment of the present invention having a shock tube fuse connected thereto and an initiation charge mounted therein.
Figure 1A:
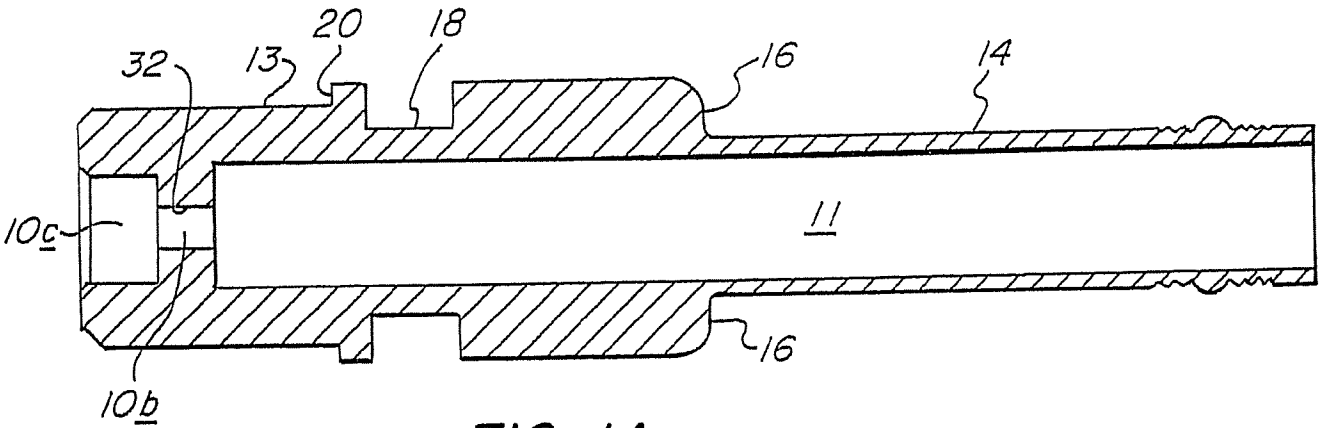
FIG. 1A is a view corresponding to that of FIG. 1, but with the shock tube fuse and initiation charge omitted.

One embodiment of an initiation fixture of the present invention is shown in FIGS. 1 and 1A. Initiation fixture 10 is a unitary, i.e., one-piece, elongated and generally tubular structure comprised of a cylindrical collet portion or body member 12 having a sleeve 14 extending therefrom, and an external positioning member or shoulder 20 extending circumferentially there-around. Shoulder 20, which is configured to bear against an internal stop member of a triggering device to properly longitudinally position the initiation fixture 10 within the device, also serves to define a nose portion 13 of body member 12. Nose portion 13 terminates in a firing face 13*a*. A longitudinal internal passage 11 extends (FIG. 1A) through fixture 10 from a first end 10*a* thereof through sleeve 14 to firing face 13*a*. A touch hole 10*b* and an initiation charge well 10*c* (FIG. 1A) are formed in internal passage 11 within nose portion 13. The interior configuration of fixture 10 is substantially the same as the interior of the fixture shown in the Shaw patent, discussed above. Body member 12 has a rounded shoulder 16 that faces towards first end 10*a* of fixture 10, and a circumferential bushing groove 18 (FIG. 1A) within which a sealing member comprising an O-ring 64 (FIG. 1) is seated. The sealing member is not a part of a unitary initiation fixture, but rather an accessory therefor. Initiation fixture 10 may be made of any suitable material. There is included within the purview of the present invention an initiation fixture, such as initiation fixture 10, which is of "unitary" construction, that is, it is an integral piece with no parts which are movable relative to each other. A preferred form of construction is to fabricate initiation fixture 10 by machining a single length of metal rod, such as an aluminum rod.

The fuses with which the fixture of this invention may be used include detonating cord (in which case a remotely actuated triggering mechanism is used) and, more usually, signal-transmission tubes. A signal-transmission tube may be any detonating or deflagrating (low velocity) signal-transmission tube or fuse which can carry a detonating signal or deflagrating signal along its interior. Such detonating signal-transmission tubes are commonly referred to as "shock tube" and may be of the type disclosed in Persson U.S. Pat. No. 3,590,739 or Thureson et al U.S. Pat. No. 4,607,573. A deflagrating signal-transmission tube may be of the type disclosed in Thureson U.S. Pat. No. 4,757,764. Such impulse transmission tubes comprise flexible hollow plastic tubes having an interior coating of a reactive material capable of carrying a detonating or deflagrating signal.

In the embodiment illustrated in FIG. 1, a signal-transmission fuse is provided by a shock tube fuse 22, one end of which is received within sleeve 14 of fixture 10 and terminates in input end 22*a* of fuse 22. An isolation member 24 is interposed between input end 22*a* of fuse 22 and an initiation charge 30, which may comprise a known type of percussion-sensitive charge. For example, initiation charge 30 may be a primer cap such as an M42C1 primer cap containing a nominal loading of 0.34 grams of a lead styphnate-tetracene, noncorrosive-type priming mixture. As is well-known in the art, isolation member 24 serves to disperse static electricity which may accumulate within or on shock tube fuse 22 to thereby avoid electrostatic discharge to initiation charge 30. A fuse bushing 26 surrounds fuse 22 which is secured in sleeve 14 by crimping sleeve 14 to form crimp 28. Input end 22*a* contacts isolation member 24, which is preferably configured to diverge from its central membrane 24*a* in the in the direction towards first end 10*a* to enable isolation member 24 to receive therein the ends of fuses of varying diameters. One type of fuse is shock tube, having an outside diameter in the range of about 0.085 inch (about 2.2 mm) to about 0.118 inch (about 3 mm) or more.

The touch hole 10*b* between initiation charge well 10*c* (FIG. 1A) and fuse 22 within sleeve 14 is formed by an internal fence 32 in fixture 10. The touch hole 10*b* provides a conduit by which the output of initiation charge 30 enters sleeve 14, penetrating the central membrane 24*a* of isolation member 24 and initiating the reactive material in fuse 22.

Initiation fixture 10 with initiation charge 30 and signal-transmission fuse 22 mounted therein provides a fuse/fixture sub-assembly 34. A detonator (not shown in FIG. 1) or other explosive or device may be connected to the output end (not shown) of fuse 22 to be acted upon by the signal to be generated in fuse 22.

Figure 2:
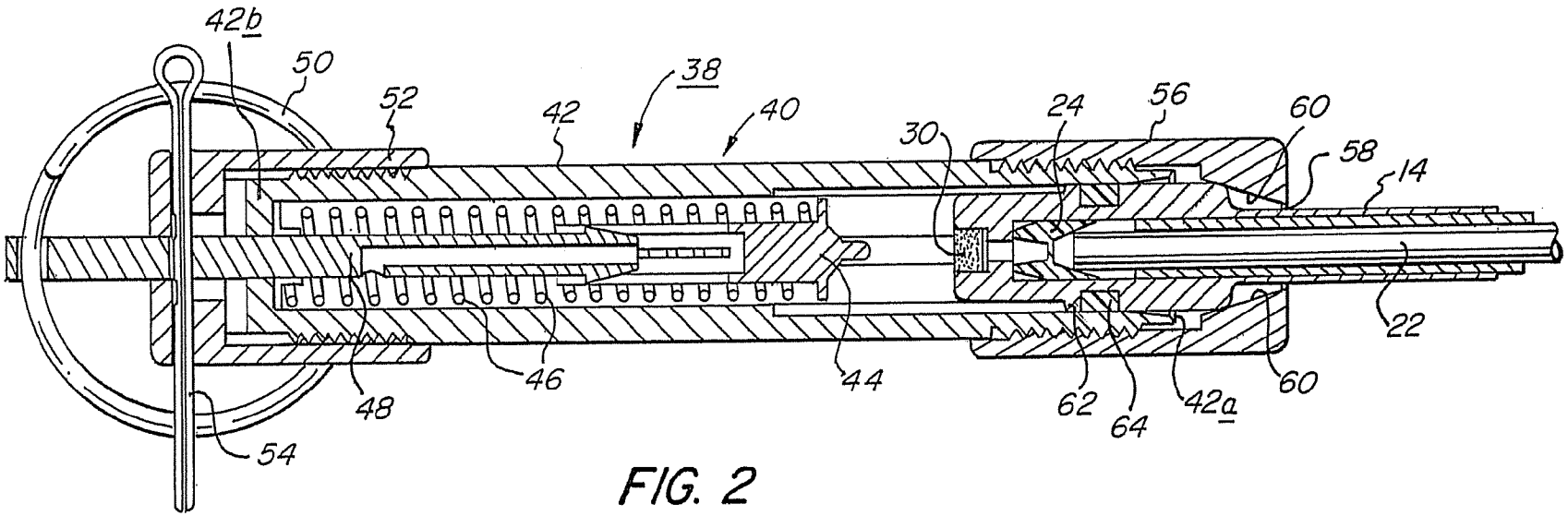
FIG. 2 is a schematic cross-sectional view of an initiator assembly in accordance with one embodiment of the present invention comprising a triggering device having the initiation fixture of FIGS. 1 and 1A secured thereto.

FIG. 2 shows an initiator assembly 38 in accordance with one embodiment of the present invention in which the fuse/fixture sub-assembly 34 of FIG. 1 is secured in a triggering device 40. As part of the assembly of triggering device 40, sleeve 14 of fixture 10 is passed through an aperture 58 in a fuse-holder cap 56 and fuse 22 is then inserted through sleeve 14 which is crimped thereon as described above. The illustrated triggering device 40 is standard United States Army issue designated as an M81 triggering device. Triggering device 40 comprises a housing or barrel 42 which is generally tubular and which is configured to receive initiation fixture 10 of sub-assembly 34 at the output end 42*a* thereof. The interior bore of output end 42*a* of barrel 42 is slightly tapered to flare outwardly, as seen in FIG. 2. Barrel 42 also encloses a spring-loaded firing mechanism comprising a firing pin 44 and a spring 46, which are shown in FIG. 2 in the pre-firing configuration, i.e., with spring 46 compressed and ready to drive firing pin 44 forward to strike initiation charge 30. A pull rod 48 extends from the barrel 42 and engages spring 46 to hold it in its compressed condition. A pull ring 50 is connected to the end of pull rod 48, which projects outwardly of a threaded top cap 52 which encloses the breech end 42*b* of the barrel 42 from which pull rod 48 extends. Pull ring 50 is rotatable about the end of pull rod 48 and is shown in FIG. 2 rotated towards the barrel 42. For safety purposes, pull rod 48 and top cap 52 are perforated to permit a cotter pin 54 to be inserted therethrough to provide a safety mechanism to prevent the inadvertent withdrawal of pull rod 48 from barrel 42. The structure and function of triggering devices such as triggering device 40 are well known to those skilled in the art, and therefore a more detailed description of such structure and function is not necessary. It suffices to say that when the user desires to initiate the signal in the signal-transmission fuse 22, cotter pin 54 is removed and the pull ring 50 is pulled to release the compressed spring 46 which drives firing pin 44 forward to strike and initiate initiation charge 30, which initiates a signal in signal transmission fuse 22.

The fuse-holder cap 56 is mounted on the output end 42*a* of barrel 42 by threaded engagement with external threads (unnumbered) adjacent the output end 42*a*. The interior of fuse-holder cap 56 includes a conical bearing surface 60. As fuse-holder cap 56 is threaded onto barrel 42, bearing surface 60 bears against rounded shoulder 16 of fixture 10, driving fixture/fuse assembly 34 into triggering device 40. Preferably, barrel 42 of device 40 includes an internal positioning member or internal stop 62 that engages shoulder 20 (see FIG. 1A) of fixture 10 so that initiation charge 30 is properly positioned in barrel 42 relative to firing pin 44.

The fixture/fuse sub-assembly 34 includes an O-ring 64 retained in bushing groove 18 (FIG. 1A). O-ring 64 is dimensioned and configured to form a water- and weather-tight seal between fixture 10 and the interior of barrel 42. The interior of barrel 42, including initiation charge 30, is thus protected against contamination from moisture or other contaminants that might otherwise enter barrel 42 through aperture 58.

Figure 3:
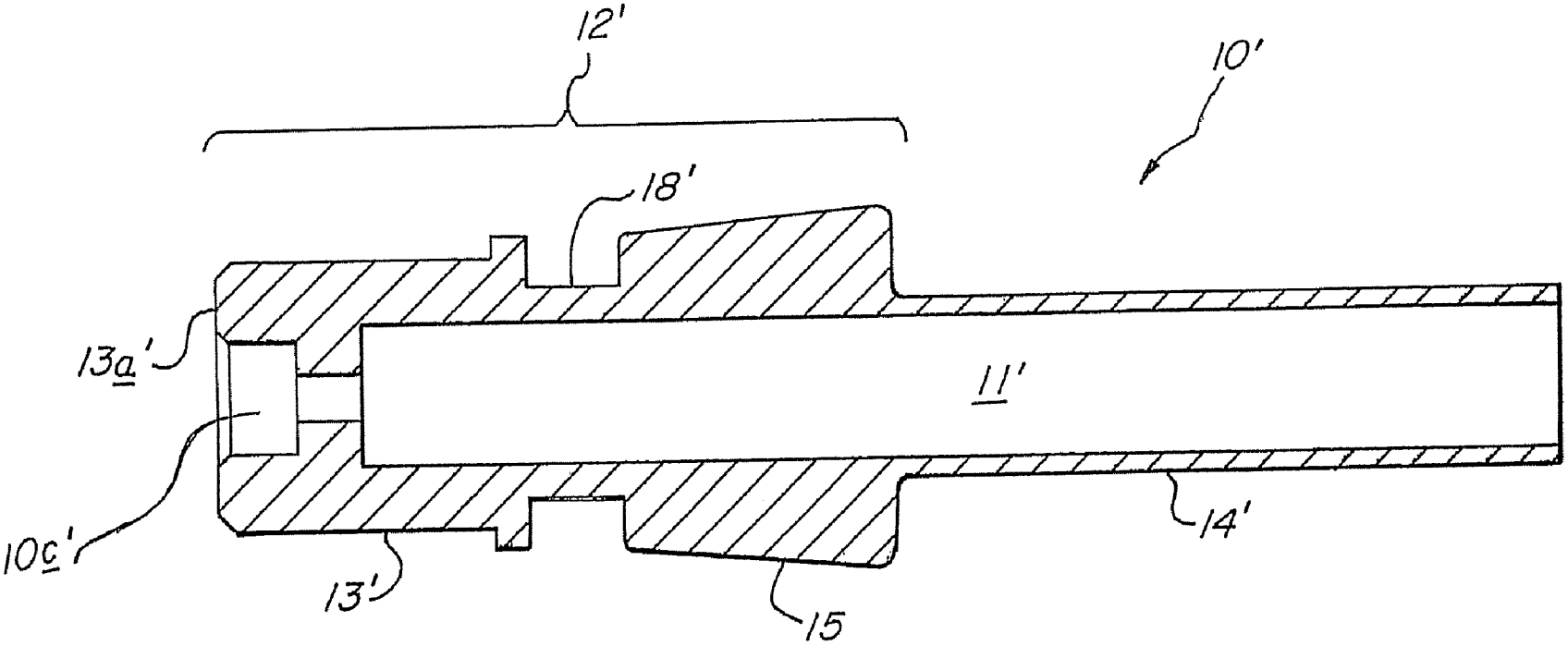
FIG. 3 is a schematic cross-sectional view of an initiation fixture in accordance with a second embodiment of the present invention.

In an alternative embodiment of the invention, the initiation fixture may be configured to conform to the tapered interior bore of output end 42*a* of barrel 42. Specifically, as shown in FIG. 3, a proximal portion 15 of body member 12' of a fixture 10' may be tapered to flare outwardly to conform to the flared interior bore of output end 42*a* of barrel 42 (FIG. 2). Body member 12' includes a nose portion 13' of uniform diameter which extends into barrel 42 (FIG. 2) beyond the tapered surface. The tapered construction of body member 12' serves to fix the longitudinal position of fixture 10' in the barrel 42 of a triggering device 40. Body member 12' has a longitudinal internal passage 11', a firing face 13*a'*, a sleeve 14', a bushing groove 18', and an initiation charge well 10*c'* which correspond to and serve the same functions as described in connection with the initiation fixture 10 of FIGS. 1 and 1A, and which therefore need not be further described.

Figure 4:
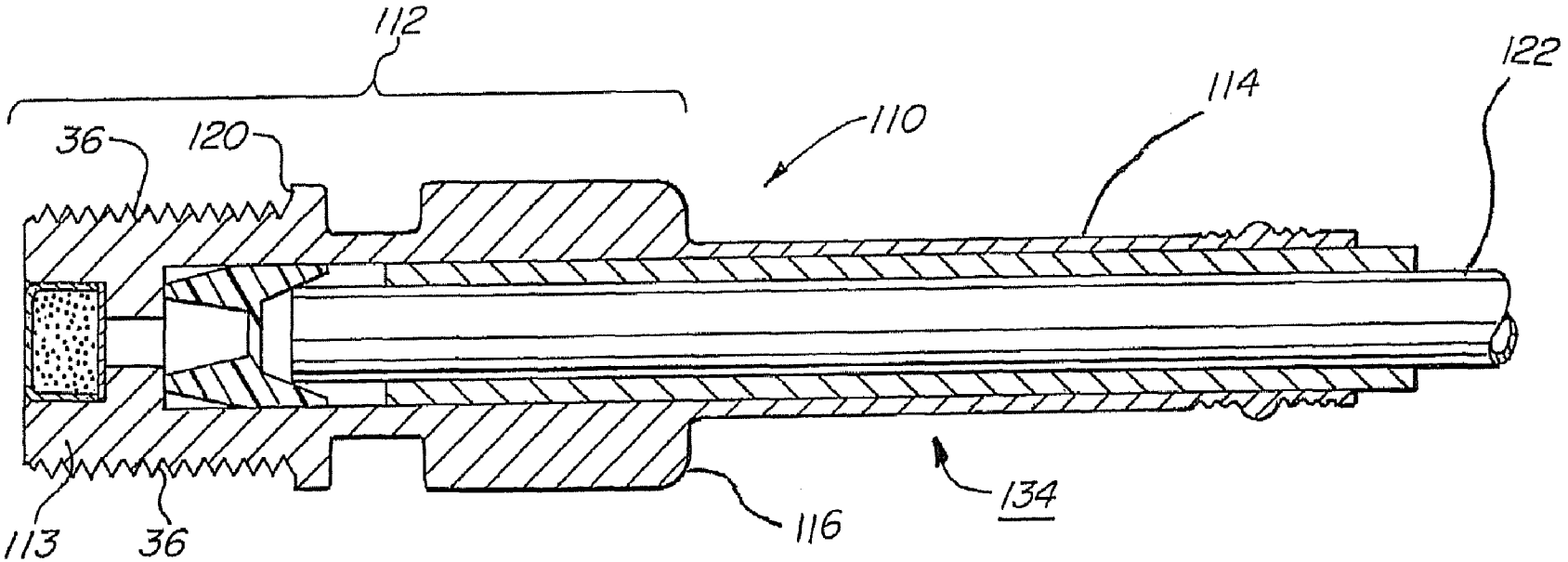
FIG. 4 is a cross-sectional view of an initiation fixture in accordance with a third embodiment of the present invention.

Referring now to FIG. 4, there is shown a fixture/fuse sub-assembly 134 comprising fixture 110, which is similar to fixture 10 of FIG. 1 except that it contains external threads 36 on nose portion 113 of body member 112. Fixture 110 has a shoulder 120, and a signal-transmission fuse 122 is received within sleeve 114. That portion of fuse 122 received within sleeve 114 is encased within a fuse bushing (not shown). The external threads 36 serve to engage internal threads disposed at one end of a triggering device to position and retain body member 112 in the barrel of a triggering device, not shown in FIG. 4. Initiation fixture 110 is a "universal" fixture as it may be secured to the barrel of a triggering device having internal threads or to the barrel of a triggering device using a fuse-holder cap, such as fuse-holder cap 56 in FIG. 2, to engage rounded shoulder 116. In such case, shoulder 120 contacts a stop member within the barrel of the triggering device to assure proper positioning.

Figure 5:
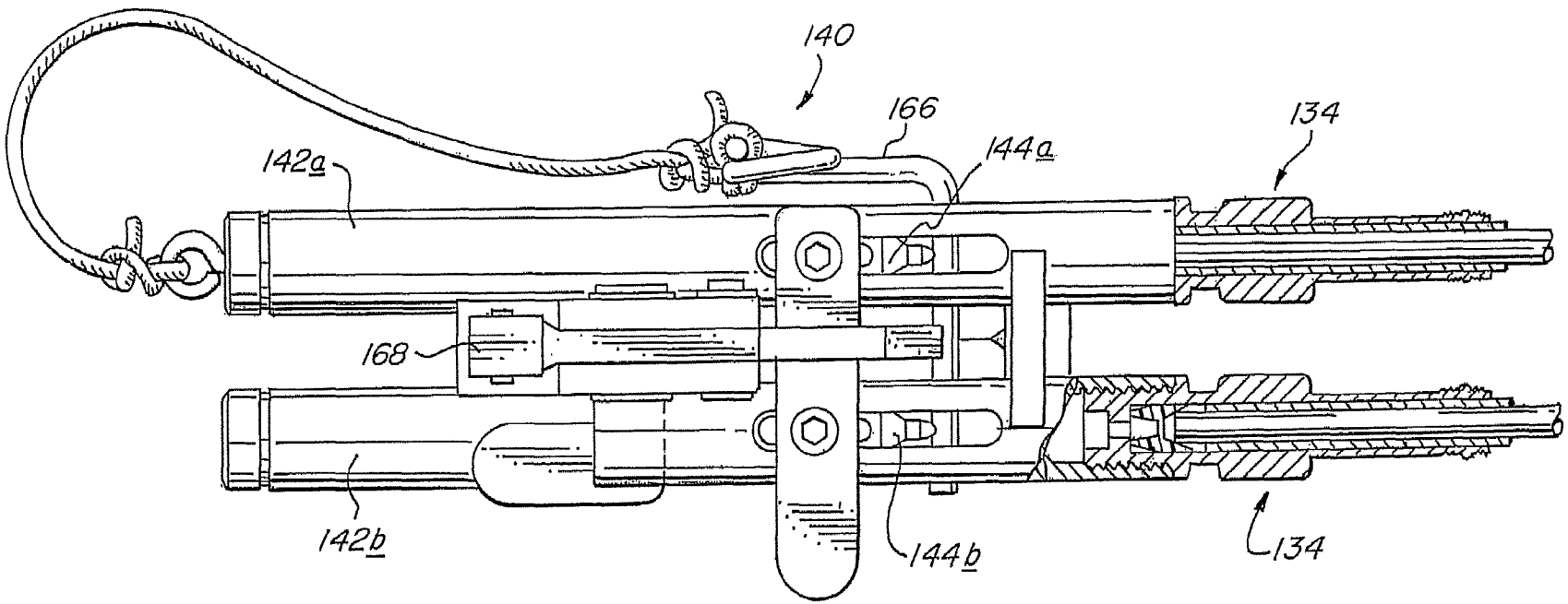
FIG. 5 is a plan view of an initiator assembly in accordance with another embodiment of the present invention comprising a dual-barrel triggering device in which two of the initiation fixtures of FIG. 4 are mounted.

Referring now to FIG. 5, there are shown two of the fixture/fuse sub-assembly 134 of FIG. 4 secured in a dual-barrel triggering device 140. The illustrated triggering device 140 is used by the United States Army under the designation MK54. The triggering device 140 comprises two barrels 142*a* and 142*b* which are generally tubular and have internal threads which are configured to receive fixture/fuse sub-assemblies 134 therein. Barrels 142*a* and 142*b* also enclose firing mechanisms comprising firing pins 144*a* and 144*b* and firing springs (not shown). Structure 144 comprises a safety-and-trigger operating structure well known in the art, and therefore the structure and function need not be further described. For use, the user removes a safety pin 166 and presses a trigger 168 to release the firing pins 144*a* and 144*b*.

Figure 6:
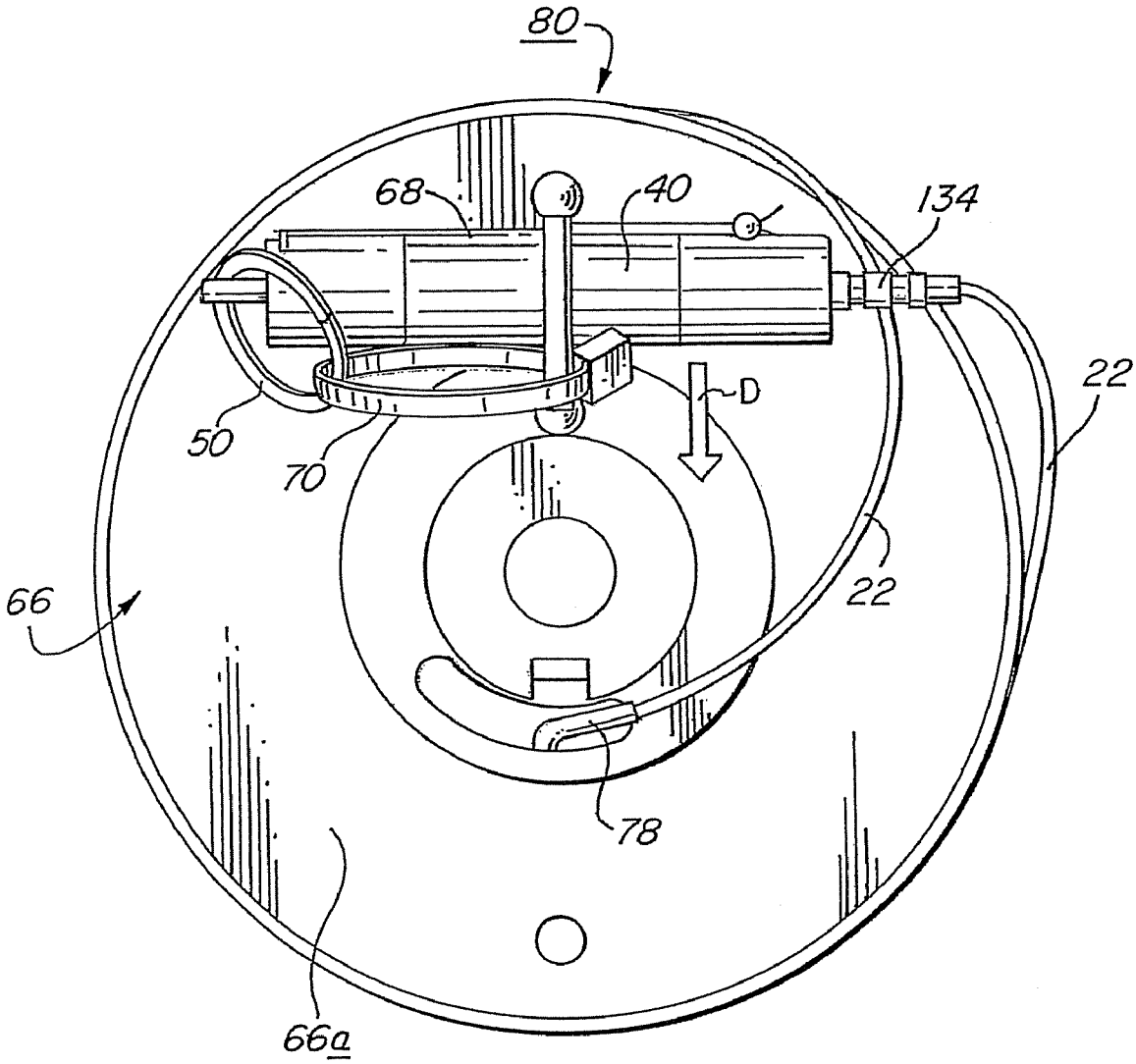
FIG. 6 is a side view of an initiator assembly in accordance with yet another embodiment of the present invention comprising a spool on which a fuse is wound and on which the triggering device is mounted.
Figure 7:
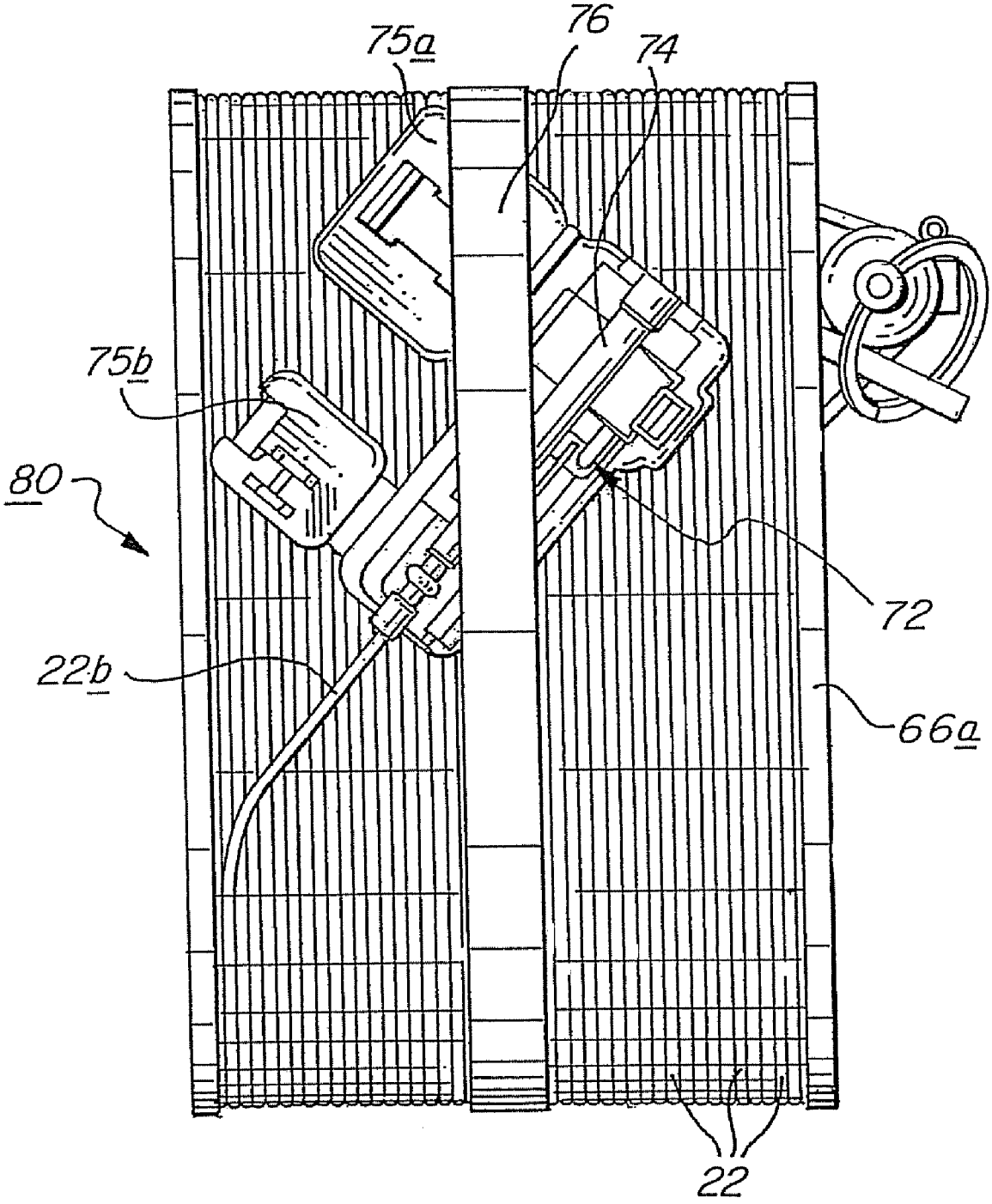
FIG. 7 is an end view of the initiator assembly of FIG. 6.

Referring now to FIGS. 6 and 7, there is shown an initiator assembly 80 comprising triggering device 40, having fixture/fuse sub-assembly 34 connected thereto as shown in FIG. 2, mounted upon a spool 66 which has a signal-transmission fuse 22 wound thereon. The triggering device 40 is mounted onto a flange 66*a* of spool 66 and is secured in place by a fastener 70. The fastener 70 is attached to pull ring 50 of triggering device 40. Triggering device 40 is secured to spool 66 by a retaining strap 68 on the flange 66*a* of spool 66. A protective sleeve 78 covers a portion of signal-transmission fuse 22 that passes through opening 79 in the flange 66*a* of spool 66.

Flexible retaining strap 68 is secured at one end to the flange 66*a* of spool 66 so that upon removing or rupturing fastener 70, triggering device 40 can quickly be removed from spool 66 by moving it in the direction of the arrow D in FIG. 6.

The initiator assembly 80 has a detonator 74 secured to an output end 22*b* (FIG. 7) of the signal-transmission fuse 22 and contained within a connector bunch block 72. Connector bunch block 72 serves, as is well known to those skilled in the art, to receive one or more, usually a plurality, of receptor signal-transmission fuses which are positioned in signal-transfer proximity to detonator 74 by placing the receptor signal-transmission tubes within connector bunch block 72 and locking them in place by closing flap 75*a*. Flap 75*b* is closed to help secure detonator 74 in place. A retaining strap 76 serves to secure connector bunch block 72 in place for storage and shipment. Obviously, any suitable connector block may be used, or the connector block may be omitted and detonator 74 left free to be inserted into an explosive charge or other device.

In use, after severing or rupturing strap 76, connector bunch block 72 is removed from spool 66 and receptor signal-transmission tubes (not shown) are passed through bunch block 72 in signal transfer proximity to detonator 74. Flaps 75*a* and 75*b* of bunch block 72 are then closed to secure the receptor signal-transmission tubes and detonator 74 in place within connector bunch block 72. With that installation complete and bunch block 72 fixed in place, the user carries spool 66 to a remote location, playing out any required length of signal-transmission tube 22 up to the capacity of tube 22 stored on spool 66. When the user is ready to initiate the signal, triggering device 40 is removed from spool 66 by moving it in the direction shown by arrow D, any safety pin or other safety device (not shown in FIG. 6) is removed or placed in the armed position, and pull ring 50 is pulled to initiate the firing sequence.

When the fixture is mounted on the end of a fuse and has an initiation charge therein, the resulting combination is a fixture/fuse sub-assembly that can be easily secured into a variety of triggering devices such as U.S. Army M60 and MK54 devices.

While the invention has been described with reference to specific embodiments thereof, it will be appreciated that numerous other variations may be made to the illustrated specific embodiments which variations nonetheless lie within the spirit and the scope of the invention.

What is claimed is:

1. An initiator assembly comprising:

(a) a triggering device having a barrel comprising an output end and an interior surface, the barrel having disposed therein an internal positioning member and a firing mechanism comprising a firing pin;

(b) an initiation fixture is of unitary construction whereby no part thereof is movable relative to any other part thereof, and the initiation fixture is secured to the triggering device and comprises: (i) a cylindrical body member having an external surface and a nose portion terminating in a firing face, the body member being configured to be received longitudinally within the barrel of the triggering device at the output end thereof,(ii) a longitudinal internal passage extending through the body member, (iii) an external positioning member disposed on the external surface of the body member and engaging the internal positioning member, thereby positioning the body member at a predetermined position within the barrel, and (iv) an initiation charge disposed within the longitudinal internal passage at the firing face of the body member and exposed to the firing pin of the firing mechanism;

(c) a signal-transmission fuse secured to and extending from the body member and having an input end disposed in signal-transfer relation to the initiation charge, and an opposite output end; and wherein the internal positioning member comprises internal threads of the barrel and the external positioning member comprises external threads on the nose portion of the body member, the external threads being dimensioned and configured to threadably engage the internal threads of the barrel.

2. The assembly of claim 1, wherein the initiation fixture further comprises a sealing member disposed circumferentially about the body member and dimensioned and configured to engage the interior surface of the barrel to form a seal therewith.

3. The assembly of claim 1, wherein the triggering device further comprises a fuse-holder cap disposed at the output end of the barrel and having therein an aperture through which the signal-transmission fuse passes.

4. The assembly of claim 3 wherein the end face of the body member is dimensioned and configured to be engaged by the fuse-holder cap to retain the body member within the barrel.

5. The assembly of claim 1, wherein the initiation fixture further comprises a sleeve extending from the end face of the body member and through which the signal-transmission fuse passes.

6. The assembly of claim 5 wherein the triggering device further comprises a fuse-holder cap disposed at the output end of the barrel, and having therein an aperture through which the sleeve of the initiation fixture extends.

7. The assembly of claim 1, wherein the triggering device is mounted on a spool on which the signal-transmission fuse is wound.

8. The assembly of claim 1, wherein the output end of the signal-transmission fuse is received within a detonator.

9. The assembly of claim 8 wherein the detonator is positioned within a connector block dimensioned and configured to receive a plurality of signal-transmission lines therein.

* * * * *